United States Patent [19]

Kohlhage et al.

[11] Patent Number: 4,753,545

[45] Date of Patent: Jun. 28, 1988

[54] REPLACEABLE RIBBON CARTRIDGE FOR PRINTERS

[75] Inventors: Hermann Kohlhage; Ruprecht Flügge, both of Paderborn, Fed. Rep. of Germany

[73] Assignee: Nixdorf Computer AG, Paderborn, Fed. Rep. of Germany

[21] Appl. No.: 50,458

[22] Filed: May 14, 1987

[30] Foreign Application Priority Data

May 15, 1986 [DE] Fed. Rep. of Germany ... 8613183[U]

[51] Int. Cl.[4] ..... B41J 35/04

[52] U.S. Cl. ..... 400/208; 400/234; 400/248; 400/248.2; 400/250

[58] Field of Search ..... 400/208, 229, 234, 248–248.2, 400/194–196.1, 250

[56] References Cited

U.S. PATENT DOCUMENTS

| | | | |
|---|---|---|---|
| 3,960,259 | 6/1976 | Guerrini | 400/248 X |
| 3,987,883 | 10/1976 | Darwin | 400/248 X |
| 4,352,575 | 10/1982 | Shore | 400/208 X |
| 4,623,274 | 11/1986 | Ohsaki | 400/234 X |

FOREIGN PATENT DOCUMENTS

| | | | |
|---|---|---|---|
| 16882 | 1/1986 | Japan | 400/250 |

*Primary Examiner*—Paul T. Sewell

*Attorney, Agent, or Firm*—Cullen, Sloman, Cantor, Grauer, Scott & Rutherford

[57] ABSTRACT

In a replaceable ribbon cartridge (12) for printers in which the ribbon (14) can be guided out of the cartridge through an exit opening (16) and at the end of a tension segment extending outside the cartridge can be reintroduced into the cartridge through an entrance opening (18), there is arranged on the cartridge (12) in the zone of the tension segment at least one deflection slide (24, 26) displaceable in a direction approximately perpendicular to the ribbon plane between a position of retraction into the cartridge (12) and an extended position deflecting the ribbon (14). Through the deflection slide or slides (24, 26), the ribbon (14) is generally spread away from the cartridge sufficiently so that upon insertion of the cartridge into the printer, it places itself around the printer head. During the last phase of insertion, the deflection slides (24, 26) are retracted, as by means of rams (56) arranged on the printer, so that during the subsequent ribbon advance, the ribbon (14) can become tensioned in its guide.

8 Claims, 2 Drawing Sheets

REPLACEABLE RIBBON CARTRIDGE FOR PRINTERS

TECHNICAL FIELD

The present invention generally relates to a replaceable ribbon cartridge, especially of the type in which a portion of the ribbon is held in tension which is impacted by a printing head.

BACKGROUND ART

In general, ink ribbons for printers and other comparable appliances are presently housed in cartridges which permit rapid and simple changing of ink ribbons. In order to keep the ribbon under tension in the printing zone, the ribbon loop extending outside the ribbon cartridge must be trained, in general, around guide webs or along the front surface of the printing head itself. Therefore, it is generally necessary, upon insertion of the ribbon cartridge, to thread the ribbon manually into the guide path, which renders the insertion process more difficult and causes the hands of the operator to be soiled by the highly staining ribbon.

A replaceable ribbon cartridge is disclosed in West German Patent Publication DE-OS No. 3214633, in which the ink ribbon is installed automatically around the guide webs upon insertion of the ribbon cartridge and subsequent feeding of the ribbon. The construction of the guide webs is comparatively costly in that either a plurality of guide webs must be mounted on each printing head carrier precisely opposite one another or must be molded integrally with the head, such that the molds and the molding process become more complicated.

SUMMARY OF THE INVENTION

The purpose of the present invention is to provide an ink ribbon cartridge which facilitates automatic threading of the ribbon without any manual intervention, is simple in construction and also permits simple construction of the printing head and cartridge carriers.

By means of an extendable deflection slide, the ribbon loop portion extending outside the cartridge is spread off the cartridge sufficiently so that it places itself about the front surface of either the printing head or guide webs. Thereafter, the deflection slides are moved into their retracted position(s) so that the ribbon is tensioned during subsequent feeding along the guide path. When the cartridge is removed, the ribbon is lifted off again from the front surface of the printing head and the guide webs by extension or moving-out of the deflection slides.

In a preferred embodiment of the invention, deflection slides are respectively arranged in the direction of moving of the ribbon behind the exit opening and ahead of the entrance opening. In this manner, the ribbon is lifted off essentially over its entire tensioned path outside the cartridge whereby the so-called threading-in process is further assisted.

In a further refinement of the invention, each deflection slide is rendered as a three-part web whose sections are connected by joints with one another. A first section of the web is firmly anchored in the cartridge. The second section is fixed in a swivelling fashion on the first one and cooperates with a swivel-actuating ram. A third section is linearly displaced by the second section. The third section constitutes the element which deflects the ribbon. The three-part web is preferably formed by a flexible material, in one piece, whereby the joints connecting the sections are rendered as so-called film hinges. Such deflection slides can be produced simply and at low cost as plastic elements.

In a still further refinement of the invention, the actuation of the deflection slides is achieved by means of swivel-actuating rams which, through openings formed in the cartridge, can be introduced into the cartridge interior and thereby swivel the second section of the deflection slide. Preferably, the deflection slides are formed of an elastic material, so that they assume their extended position in an elastically relaxed state and so that they can be shifted to an elastically tensioned retracted position by means of the actuating rams. The swivel-actuating rams are designed in the form of pins which are fixedly arranged in the cartridge seat of the printer and which, when the ink ribbon cartridge is inserted, penetrate the openings formed on the cartridge. Accordingly, the ribbon in its normal condition is spread out off the cartridge and is ready for insertion. When the cartridge is set in, the pins penetrate the cartridge and, during the last phase of the insertion process, the deflection slides are retracted so that the ink ribbon applies itself against the guide webs and, respectively, the front surface of the printing head.

DESCRIPTION OF THE PREFERRED EMBODIMENTS

Figure 1:
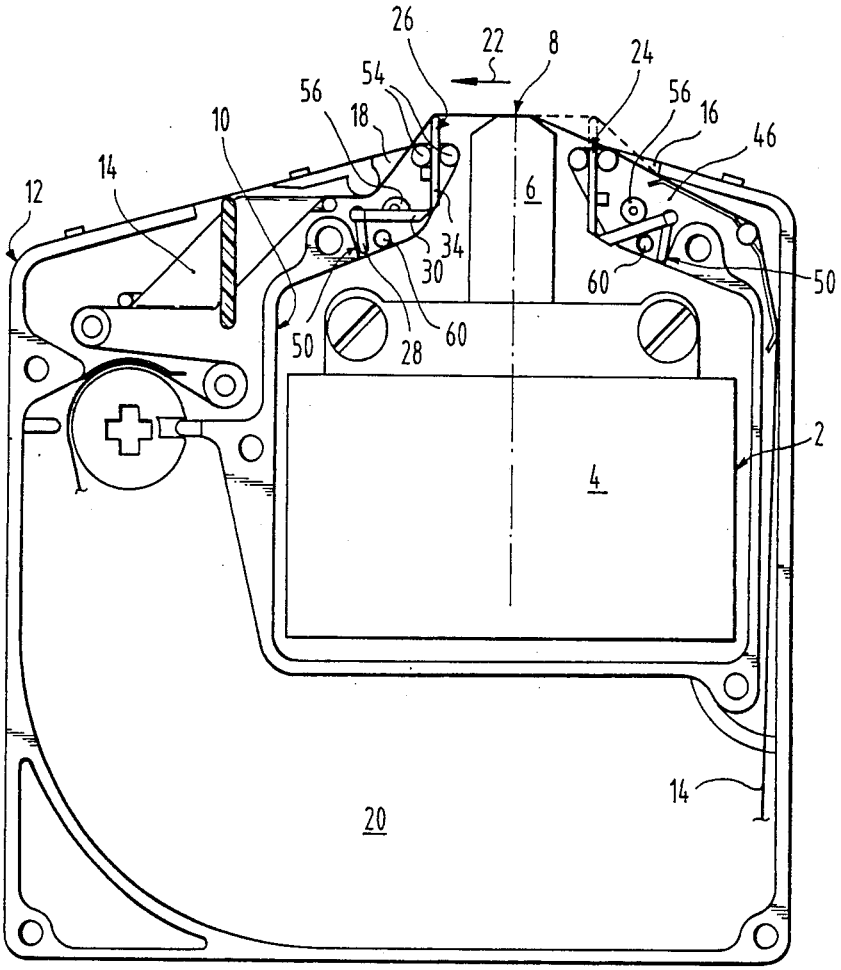
FIG. 1 shows a plan view of a printing head as well as an ink ribbon cartridge in accordance with the present invention, wherein the upper cover has been removed.

The embodiment chosen to illustrate the invention and described below is particularly suited for a dot matrix printer. FIG. 1 shows a matrix printer head 2 with a driving element 4 and a pin guide element 6 directed towards the printing plane. The matrix printer head 2 is fixed in a conventional manner on the printer head support of a printer, not shown. The printing plane extends a small distance from the front surface 8 of the pin guide element 6 perpendicular to the plane of the drawing.

A conventional ribbon cartridge 12, which receives the matrix printer head 2 within a clearance 10, is likewise supported on the printer head support. It contains an ink ribbon 14 which emerges from the ribbon cartridge through an exit opening 16 and is introduced again into the cartridge through an entrance opening 18. In the example illustrated, the ribbon cartridge is of the type in which the ribbon 14 is arranged in a plurality of loops, which need not be shown in detail, in a retaining space 20.

In the region between the exit opening 16 and the entrance opening 18, the ribbon 14 extends outside the cartridge. This region will be referred to as the tension segment hereinafter. Over the tension segment, the ink ribbon is maintained in a state of tension so that it moves free from folds along and in front of the printing plane.

The direction of the ribbon advance is indicated by the arrow 22.

In the direction of ribbon advance behind the exit opening 16 and ahead of the entrance opening 18 are respectively arranged deflection slides 24, 26, each of which are displaceable approximately perpendicular to the plane of the ribbon between a position retracted into the ribbon cartridge 12 and an extended or actuated position in which the ribbon 14 is deflected from its normal position. The two deflection slides 24, 26 are actuated simultaneously and in the same direction so that both deflection slides are always either retracted or extended. It is only in order to simplify the drawings that in FIG. 1 the deflection slide 24 is shown in the retracted position, whereas the deflection slide 26 is shown in the extended position.

When the ribbon cartridge 12 is installed on the printer head support, both deflection slides 24, 26 are in the extended position so that the ribbon 14 is spread sufficiently forward in order to position itself in front of the front surface 8 of the pin guide element 6 without being caught thereon. In this manner, the ribbon follows the line which in FIG. 1 is shown as a full line on the left side and as a broken line on the right side.

It is only during the last phase of the seating movement that the deflection slides 24, 26 are moved into their retracted position so that the ribbon 14 can stretch itself around the front surface 8 of the pin guide element 6. It then follows, on both sides, the path shown in full line on the right side.

Figure 2:
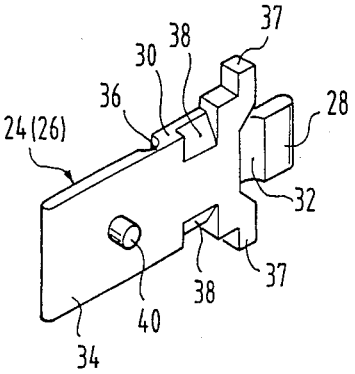
FIG. 2 is a perspective view of a deflection slide of the kind employed in the cartridge shown in FIG. 1.

The deflection slides 24, 26 each consist of a three-sectioned web having the shape shown in perspective in FIG. 2. The web has three sections which are connected with one another by joints. The first, anchoring section 28 is firmly clamped into the cartridge. The second, actuation section 30 is connected with the anchoring section 28 in a swivelling fashion by way of a hinge-like joint 32 and cooperates with a swivel-actuation ram, as will be explained in greater detail below. The third deflection section 34 is connected in a swivelling fashion with the actuation section 30 by way of a hinge-like joint 36 and is driven thereby so as to achieve linear displacement movement.

On the actuation section there are formed two swivel bearing journals 37 as well as two ramp-like actuation surfaces 38. On the deflection section 34, there is provided a stop in pin 40.

Figure 3:
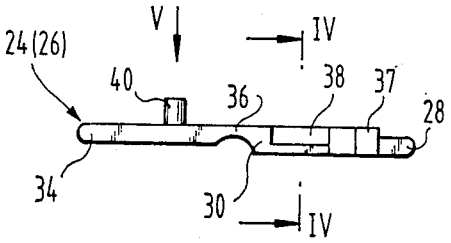
FIGS. 3 to 6 show various views of the deflection slide depicted in FIG. 2.

The functioning of the deflection slide 24, 26 will now be explained in greater detail. The deflection slide 24, 26 is molded in one piece, preferably of an elastic plastic material. The joints 32, 36 are formed by thinned material regions to form so-called film hinges. FIG. 3 shows a deflection slide 24, 26 in side view.

Figure 4:
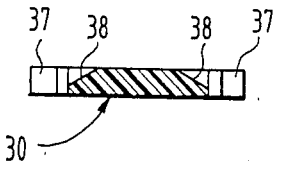

FIG. 4 represents a cross-section through the zone of the actuation section 30 corresponding to the line IV—IV in FIG. 3 and more clearly shows the ramp-like actuations surfaces 38 and the swivel bearing journals 37.

Figure 5:
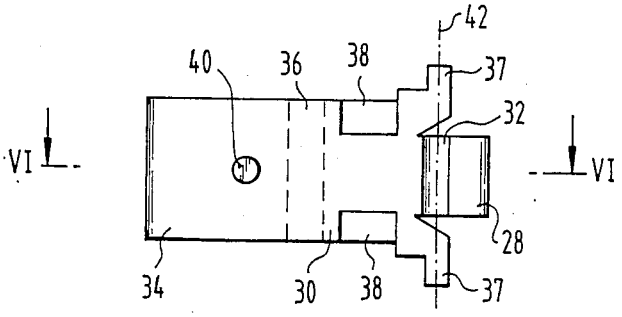

FIG. 5 is a plan view of a deflection slide 24, 26 taken along the line of view V in FIG. 3. It is particularly clear in this view that the axis 42 of the swivel bearing journal 37 coincides with the theoretical axis of the joint 32. The axis 42 is the pivoting axis for the actuation section 30.

Figure 6:
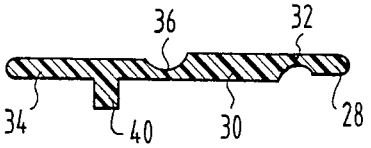

FIG. 6 shows a longitudinal section corresponding to the line VI—VI in FIG. 3. From this figure, it becomes clear that the joints 32, 36 are each formed as film hinges with a smaller thickness of the material, whereby the hinge webs are each formed on different sides of the deflection slide, corresponding to the bending direction indicated by FIGS. 1 and 7.

Figure 7:
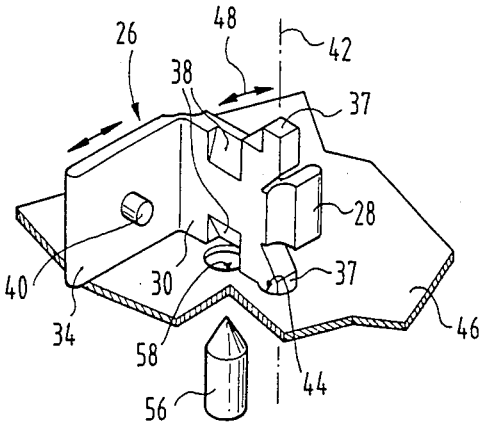
FIG. 7 is a perspective view of the deflection slide mounted on the cartridge and shown in operative relationship to the ram.

From FIGS. 1 and 7, it is apparent that the swivel bearing journals 37 are supported in journal rests 44 in the bottom 46 of the cartridge and, not shown in detail, in the cover of the cartridge, where they pivot in the direction of the arrow 48.

The anchoring section 28 is loaded elastically against a material web 50 so that the actuation section 30 is pretensioned in the direction of extension or actuation of the deflection section 34. The deflection section 34 is displaceable in the direction of the arrow 52, between two guide webs 54. The outward path of movement is limited by the abutment of the stop pin 40 against one of the guide webs 54.

With each deflection slide 26, there is associated a swivel actuation ram 56 which is fixed on the printer head support. Upon seating of the ink ribbon cartridge, the swivel actuation rams 56 each pass through openings 58 in the bottom 46 of the cartridge and apply themselves against one of the ramp-like actuation surfaces 38 so that the actuation section is swivelled so as to result in a retraction of the deflection section 34.

The design of the swivel actuation ram 56 and of the actuation surfaces 38 is chosen in a manner such that the retraction of the actuation section 34 occurs only in the last phase of the seating movement of the ink ribbon cartridge on the printer head support. The swivel movement of the actuation section 30 related to retraction is limited by a stop pin 60.

It is clear from FIG. 5 in particular that each deflection slide is designed to be symmetrical with respect to a plane which is perpendicular to the drawing plane and contains the dividing line VI—VI, so that each deflection slide is suitable for arrangement on either side of the pin guide element 6.

What is claimed is:

1. An improved replaceable ribbon cartridge for printers of the type including a ribbon exit opening through which the ribbon can be guided out of the cartridge to an area where a segment of the ribbon is held in tension and a ribbon entrance opening into which the ribbon can be reintroduced from the area of ribbon tension, wherein the improvement comprises:

at least one deflection slide (24, 26) mounted on said cartridge (12) in the area of ribbon tension, the deflection slide (24,26) being displaceable in a direction generally perpendicular to the plane of the ribbon between a retracted position within the cartridge (12) and an extended position engaging and deflecting the ribbon (14) in the area of ribbon tension, the deflection slide (24,26) being generally defined by a web including three sections disposed generally symmetrical with respect to a plane extending parallel to the plane of the cartridge, the sections (28, 30, 34) of the web being connected with each other by joints (32, 36), the first section defining an anchoring section (28) fixedly arranged in the cartridge (12), the second section defining an actuation section adjacent said anchoring section and arranged so that it can swivel in the cartridge plane perpendicular to the ribbon plane, the third section defining a linearly displaceable deflection section (34); and a swivel actuation ram (56) cooperating with the actuation section.

2. The improved cartridge of claim 1, including a pair of the deflection slides (24, 26) respectively arranged behind the ribbon exit opening (16) and ahead of the ribbon entrance opening (18) in the direction of advance of the ribbon.

3. The improved ribbon cartridge of claim 1, wherein the deflection slide (24, 26) is molded in one piece of flexible material and wherein the joints (32, 36) are formed as hinges with a thinner material corss-section arranged between the sections (28, 30, 34).

4. The improved ribbon cartridge of claim 1, wherein the cartridge (12) includes openings formed therein (58) through which the swivel actuation ram (56) can be introduced into the cartridge interior.

5. The improved ribbon cartridge of claim 1, wherein the actuation section (30) is provided with swivel bearing journals (37) which are retained in journal retainers (44) formed in the cartridge.

6. The improved ribbon cartridge of claim 1, wherein the actuation section (30) includes at least one ramp-like actuation surface (38) formed thereon which is inclined relative to a reference plane extending perpendicular to the cartridge plane, the swivel actuation ram (56) being defined by a pin which is moveable in the reference plane relative to the cartridge (12) and engages the actuation surface (38), the pin being fixedly arranged on the printer and upon insertion of the ribbon cartridge penetrating the ribbon cartridge through openings (58) formed therein.

7. The improved ribbon cartridge of claim 3, wherein the deflection slide (24, 26) is composed of an elastic material, the deflection slide (24, 26) being in an elastically untensioned state in its extended position and being in an elastically tensioned state upon displacement thereof by the actuating ram to its retracted position.

8. The improved ribbon cartridge of claim 1, wherein the cartridge (12) is provided with a stop (60) to limit the swivel angle of the actuation section (30).

* * * * *